US006365563B1

(12) United States Patent
Hirsch et al.

(10) Patent No.: US 6,365,563 B1
(45) **Date of Patent: *Apr. 2, 2002**

(54) AGGLOMERATED ANTIMICROBIAL DETERGENT ADDITIVE COMPRISING SWELLABLE LAYERED SILICATE AND SURFACTANT

(75) Inventors: Rüdiger Hirsch, Stolberg (DE); Werner Hölzl, Eschentzwiller (FR); Marcel Schnyder, Birsfelden; Rainer Hans Traber, Reinach, both of (CH)

(73) Assignee: Ciba Specialty Chemicals Corporation, Tarrytown, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/153,737

(22) Filed: Sep. 15, 1998

(30) Foreign Application Priority Data

Sep. 17, 1997 (EP) ..... 97810672

(51) Int. Cl.[7] ..... C11D 3/48

(52) U.S. Cl. ..... 510/319; 510/349; 510/388; 510/387; 510/444; 510/507; 510/511

(58) Field of Search ..... 510/507, 511, 510/444, 387, 388, 319, 349

(56) References Cited

U.S. PATENT DOCUMENTS

| | | | | | |
|---|---|---|---|---|---|
| 4,472,287 | A | * | 9/1984 | Ramachandran et al. | 510/292 |
| 4,524,012 | A | * | 6/1985 | Wixon | 510/334 |
| 4,569,773 | A | * | 2/1986 | Ramachandran et al. | 510/327 |
| 4,582,615 | A | * | 4/1986 | Ramachandran et al. | 8/137 |
| 4,609,473 | A | * | 9/1986 | Ramachandran et al. | 8/137 |
| 4,861,510 | A | * | 8/1989 | Wilms et al. | 510/443 |
| 5,300,236 | A | | 4/1994 | Bortolotti et al. | 252/8.6 |
| 5,840,323 | A | * | 11/1998 | Taha et al. | 424/405 |

FOREIGN PATENT DOCUMENTS

| | | | |
|---|---|---|---|
| EP | 0361919 | | 4/1990 |
| GB | 2 085 300 | * | 4/1982 |
| GB | 2182051 | | 5/1987 |
| JP | 09-194899 | * | 7/1997 |
| WO | 90/00189 | | 1/1990 |
| WO | 91/14762 | | 10/1991 |
| WO | 96/06153 | | 2/1996 |
| WO | 97/13831 | | 4/1997 |

OTHER PUBLICATIONS

Derwent Abstr. 97–431777, for JP 9194899, Jul. 22, 1997.

* cited by examiner

*Primary Examiner*—Cynthia H. Kelly
*Assistant Examiner*—Dawn Garrett
(74) *Attorney, Agent, or Firm*—Kevin T. Mansfield

(57) ABSTRACT

A detergent additive is described, which comprises at least one swellable layered silicate, an antimicrobial active substance and a surfactant and, optionally, an alkali salt. This detergent additive is distinguished in that it protects the antimicrobial active substance from oxidation by the bleaches which are usually present in detergents and in that said active substance is only released during the washing process.

13 Claims, No Drawings

AGGLOMERATED ANTIMICROBIAL DETERGENT ADDITIVE COMPRISING SWELLABLE LAYERED SILICATE AND SURFACTANT

The present invention relates to an antimicrobial detergent additive, to a process for its preparation as well as to a detergent comprising said detergent additive.

Textile fibre materials may be antimicrobially finished in different ways, for example in the course of the washing process. Unfortunately, antimicrobial active substances are oxidationsensitive against the bleaching components present in the detergent, for example perborates, so that the antimicrobial effect of such a detergent can be markedly impaired or may even be completely non-existent.

Accordingly, the object of this invention is to provide an antimicrobial detergent additive which remains oxidation-stable with respect to the other detergent components, thus providing the detergent as a whole with good storage stability and simultaneously causing the anti-microbial effect to fully unfold during the washing process.

Surprisingly, it has been found that these conditions are met by a detergent additive in agglomerate form (granulate form), which comprises besides the antimicrobial active substance at least one swellable layered silicate and a surfactant, i.e. the antimicrobial active substance present in this detergent additive is protected against oxidants and is available in the washing solution after the agglomerate has dissolved. The detergent additive has good mechanical stability and good storage stability and decomposes well in water, and the anti-microbial active substance is homogeneously distributed during the washing process Accordingly, this invention relates to a detergent additive in agglomerate form, which comprises at least one swellable layered silicate, an antimicrobial active substance and a surfactant.

In addition to the swellable layered silicate, the antimicrobial active substance and the surfactant, the detergent additive optionally comprises an alkali salt, such as alkali sulfate, alkali carbonate or alkali (poly)phosphate.

The detergent additive according to this invention preferably comprises (a) 5 to 60% by weight of swellable layered silicate;

(b) 5 to 35 by weight of surfactant;

(c) 0.1 to 20% by weight of an antimicrobial active substance; and (c) 0 to 60% by weight of alkali salt.

The swellable layered silicate is preferably a natural or synthetic clay mineral or a synthetic sodium silicate in laminar form. The swellable clay mineral is preferably montmorillonite, beidelite, saponite or hectorite.

The layered silicate is very particularly preferably finely ground bentonite. Bentonite contains montmorillonite as main mineral which is a swellable dioctahedric natural layered silicate of formula $$Na_{0.66}(OH)_4Si_8(Al_{3.34}\cdot Mg_{0.66})O_{20}.$$

Each layer is composed of three parts, two tetrahedric layers with Si as central atom enclosing an octahedric layer with Al as central atom. As is obvious from the general formula, $Al^{3+}$ is partially isomorphically replaced by $Mg^{2+}$. The resultant excess charge is compensated between the layers by $Na^+$ or $Ca^{2+}$. The montmorillonite can be used in the sodium or calcium form or in the form of a calcium montmorillonite in which the calcium ion is replaced by soda ions.

The bentonite powder preferably has a residual moisture content of about 10% by weight and a residue on sieve of not more than 30% per 45 $\mu$m.

Besides these natural minerals it is also possible to use synthetically produced clay minerals from the above group, for example synthetic laminar sodium silicates (e.g. the commercial product SKS 6, of Hoechst AG).

The layered silicate is preferably used in an amount of 10 to 50% by weight, preferably of 30 to 50% by weight.

The swellable layered silicates have the property of intercalating polar agents between the silicate laminates under inner-crystalline swelling which, at higher concentrations, results in an increased interspace between the layers.

The surfactant used according to this invention is preferably an anionic or nonionic surfactant.

Suitable anionic surfactants are preferably those compounds which are selected from the group consisting of the acid esters or the salts thereof of alkylene oxide adducts of formula

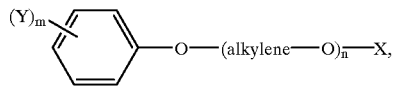

(1)

wherein

X is the acid radical of an inorganic oxygen-containing acid; such as sulfuric acid or, preferably, phosphoric acid, or also the radical of an organic acid, and Y is $C_1$–$C_{12}$alkyl, aryl or aralkyl, "alkylene" denotes the ethylene radical or propylene radical, and m is 1 to 4, and n is 4 to 50;

polystyrene sulfonates, fatty acid taurides, alkylated diphenyl oxide mono- or disulfonates, sulfonates of polycarboxylic acid esters, addition products of 1 to 60, preferably of 2 to 30 mol, of ethylene oxide and/or propylene oxide with fatty amines, fatty amides, fatty acids or fatty alcohols, each of which contains 8 to 22 carbon atoms, or with tri- to hexavalent alkanols containing 3 to 6 carbon atoms, which addition products are converted with an organic dicarboxylic acid or an inorganic polybasic acid to an acid ester, lignin sulfonates, and formaldehyde condensates.

Suitable nonionic surfactants are preferably fatty alcohol ethoxylates of formula $$R—O—(EO)_y—H, \quad (2)$$

wherein

R is a hydrocarbon radical of 10 to 18, preferably of 12 to 18, carbon atoms; or a radical of formula (2a)

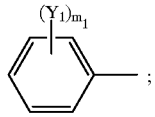

EO is an ethylene oxide group;

$Y_1$ is $C_1$–$C_{12}$alkyl, aryl or aralkyl;

$m_1$ is 1 to 4;

and y is a number from 2 to 20, preferably from 3 to 10.

The nonionic surfactants used according to this invention may also be alkylene oxide adducts with saturated or unsaturated 1–6-valent aliphatic alcohols, fatty acids, fatty amines, fatty amides, diamines and sorbitan esters, alkylene oxide condensates (block polymers), polymers of vinylpyrrolidone, vinylacetate or vinyl alcohol, and co- or terpolymers of vinylpyrrolidone with vinylacetate and/or vinyl alcohol.

Specific mixtures of the above-mentioned anionic and nonionic surfactants can also be prepared and used according to this invention.

It is preferred to use nonionic surfactants of formula (2), wherein

R is $C_{12}$–$C_{15}$alkyl; or a radical of formula (2a); and y is 3 to 10.

The fatty alcohol ethoxylates are intercalated between the layers. The nonionic surfactants in which the antimicrobial active substances are soluble promote the transport thereof between the laminates of the swellable layered silicate. The antimicrobial active substances are intercalated between the laminates of the layered silicate and are thus protected from reacting with other components of the detergent.

The granular layered silicates intercalated with surfactants and the antimicrobial active substance swell in water and release the surfactants and antimicrobial active substance of the solution into water. The swelling activity of the layered silicate agglomerate in water blasts the agglomerates and disperses them in the water.

Suitable antimicrobial active substances are preferably compounds of formula (3)

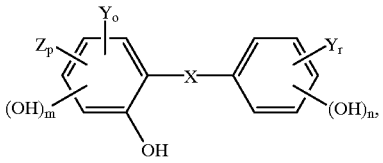

wherein

X is oxygen, sulfur or —$CH_2$—,

Y is chloro or bromo,

Z is $SO_2H$,$NO_2$ or $C_1$–$C_4$alkyl, r is 0 to 3, o is 0 to 3, p is 0 or 1, m is 0 or 1, and n is 0 or 1.

Particularly interesting compounds are those of formula (3), wherein

X is oxygen, sulfur or —$CH_2$—, and

Y is chloro or bromo, m is 0, n is 0 or 1, o is 1 or 2, r is 1 or 2, and p is 0.

Particularly interesting diphenyl ethers correspond to formula (4)

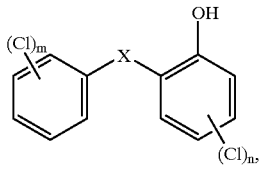

wherein

X is —O—or —$CH_2$—;

m is 1 to 3; and n is 1 or 2.

A very particularly preferred compound is 2,4,4'-trichloro-2-hydroxydiphenyl ether (Triclosan), corresponding to formula (5)

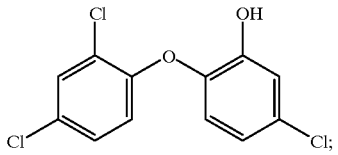

or the compound (6)

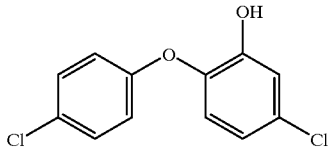

(Diclosan)

Antimicrobial active substances used in the novel detergent additive may also be phenol derivatives, benzyl alcohols, chlorhexidine, $C_{12}$–$C_{14}$alkylbetaines, $C_8$–$C_{18}$fatty acid amido alkyl-betaines, amphoteric surfactants, trihalocarbanilides and quaternary ammonium salts. Such antimicrobial active substances are described in detail in EP-A-0, 777,717 and WO 97/46218.

The active inventive detergent additive can comprise one active substance or a mixture of several active substances.

Suitable alkali salts are in particular alkali sulfate, alkali carbonate or alkali (poly)phosphate in the form of their sodium or potassium salts. Sodium sulfate is particularly preferred.

The alkali salt fulfills several functions: if the layered silicate is agglomerated with the surfactant, a soft agglomerate is obtained which becomes tacky as the surfactant content increases and which is not flowable and cannot be stored in silos. The presence of the alkali salt improves the mechanical stability of the agglomerate and reduces its tackiness. Furthermore, the presence of the alkali salt is desired in the detergent as builder component. The alkali salt is preferably used in amounts of about 10 to 40% by weight, more preferably of about 12 to 30% by weight.

Owing to the hygroscopic properties of the surfactant, the agglomerate particles of the novel detergent additive can be coated preferably with synthetic zeolite or laminar sodium silicate, thus improving the flowability of the agglomerate particles. Being coated with zeolite or laminar sodium silicate also improves the whiteness of the agglomerate.

The agglomerate preferably has a bulk density of more than 700 g/l, and because of this high bulk density it is compatible with highly concentrated detergents.

In another of its aspects, this invention relates to a process for the preparation of the above-described detergent additive in agglomerate form. This process comprises (a) adding the antimicrobial active substance in the form of an aqueous dispersion to the layered silicate at the same time as the surfactant, or (b) first dissolving at least part of the antimicrobial active substance in the surfactant and then adding the solution to the layered silicate.

The swellable layered silicate is preferably mixed with the alkali salt prior to the addition of the antimicrobial active substance/surfactant.

The powder components can be mixed, for example, in an intensive mixer, e.g. in an Eirich mixer. The antimicrobial active substance (preferably in the form of an aqueous dispersion) and the surfactant are then added with swirling either simultaneously or one after the other to the powder component. An agglomerate forms which is powdered at low mixing speed with the zeolite or with a laminar sodium silicate. The resultant agglomerate is sieved and can be coated on the surface by addition of further zeolite (preferably zeolite P) or laminar sodium silicate in powder form to reduce tackiness.

The agglomerate obtained is readily dispersible in water. The antimicrobial active substance is protected against oxidants present in the detergent and is available after the agglomerate has dissolved in the detergent solution.

This invention also relates to a detergent which comprises the above detergent additive in addition to customary detergent components such as anionic and nonionic surfactants, builder substances, polymers (co-builders), graying inhibitors, bleaches and bleach activators, enzymes, foam inhibitors, fluorescent whitening agents and fragrances and/or colourants.

The preferred method of preparation is described hereinafter.

The powdered layered silicate and the powdered sodium salt are vigorously premixed. The surfactant, or a solution of the surfactant, is added while vigorously swirling the powder mixture. At the same time, the antimicrobial active substance or a mixture of different antimicrobial active substances are added in the form of an aqueous dispersion (slurry). Alternatively, a solution of the antimicrobial active substance can be added in a surfactant solution to the powder mixture.

If the antimicrobial active substance is added in the form of an aqueous dispersion then the mixture agglomerates at a water content of about 20 to 30% by weight, based on the entire mixture. After mixing for about 2 to 5 minutes, an agglomerate is obtained which is dried in a suitable drier, preferably in a fluidised bed drier, to a residual water content of about 2 to 15% by weight, preferably of about 5 to 10% by weight. The agglomerate obtained is sieved with a sieving machine to a particle size of about 0.2 to 2.5 mm, preferably of 0.5 to 1.7 mm. The fraction <0.2 mm is again added to the agglomeration. Resulting coarse grain is comminuted with a roll crusher and placed once more on the sieving machine.

If part of the antimicrobial active substance is added to the powder mixture together with the surfactant, then the antimicrobial active substance in powder form is first dissolved in the surfactant. The weight ratio between the surfactant and the antimicrobial active substance may be from 15:2 to 4:10, preferably from 10:3 to 10:8. The solution or dispersion of the antimicrobial active substance in the surfactant is added to the powder with vigorous swirling, adding at the same time further amounts of the antimicrobial active substance in aqueous dispersion.

After mixing for about 2 to 5 minutes, an agglomerate is formed which, however, can be somewhat tacky owing to the presence of the surfactant and which therefore tends to cake. The addition of about 0.5 to 5% by weight of a synthetic zeolite or of a fine-grained sodium silicate (e.g. the commercial product SKS 6, of Hoechst AG) during the last 30 seconds of the agglomeration process reduces the tackiness of the agglomerate to such a degree that the agglomerate can be dried in a fluidised bed and can be sieved as described.

As additional step, the sieved agglomerate can be placed in a drum mixer (e.g. a drum mixer of Telschig) or on a balling disk. About 3 to 15% by weight, preferably about 5 to 10% by weight, of a synthetic zeolite or of a synthetic layered silicate are then added in fine-grained form. The average particle size of this powder should preferably be <20 $\mu$m, more preferably from 3 to 10 $\mu$m. When mixing the agglomerate with the powder, the latter accumulates on the outer surface of the agglomerate.

The detergent additive prepared in this manner has a bulk density higher than 700 g/l so that it is compatible with detergents of high bulk density. Owing to the swelling effect of the layered silicates present in the detergent additive, the agglomerates rapidly decompose in water. The active components surfactant and antimicrobial active substance are then available in the detergent. The presence of layered silicate and alkali salt provides mechanical stability to the agglomerate. The agglomerate can be subsequently added to the detergent so that essential parts of the detergent production plant are not contaminated with the antimicrobial active substance.

It is another advantage of the novel detergent additive that its application to a carrier increases the precise metering of the active substance during the production of the detergent.

The following Examples illustrate the invention without limiting it in any way.

Preparation of the novel detergent additive

EXAMPLE 1

60 g of bentonite are stirred for about 2 min with 20.0 g of sodium sulfate (anhydrous) in a mixer glass fitted with a blade agitator. Over 1 minute, a solution consisting of 20.1 g of a 15% solution of Triclosan in $C_{12}$–$C_{15}$oxoalcoholethoxylate with 5 ethylene oxide units is added dropwise. The partly granular mixture is thoroughly mixed in a mixer and heats up very much in the process.

8.1 g of deionised water are then added dropwise through the aperture in the mixer glass and the mixture is thoroughly mixed, resulting in a grayish granulate.

The sample is dried for 4 hours at 65° C. under vacuum and is then sieved through 3 sieves having a mesh width of 2, 1 and 0.5 mm.

EXAMPLE 2

60 g of bentonite are stirred for about 2 min with 20.0 g sodium sulfate (anhydrous) in a mixer glass fitted with a blade agitator. Over 1 minute, a solution consisting of 20.1 g a 15% solution of Triclosan in nonylphenylethoxylate with 6.5 ethylene oxide units is added dropwise. The partly granular mixture is thoroughly mixed for about 1.5 minutes in a mixer and heats up very much in the process.

5.4 g of deionised water are then added dropwise through the aperture in the mixer glass and the mixture is thoroughly mixed, resulting in a grayish granulate.

The sample is dried for 4 hours at 65° C. under vacuum and is then sieved through 3 sieves having a mesh width of 2, 1 and 0.5 mm.

EXAMPLE 3

60 g of bentonite are stirred for about 2 min with 20.0 g of sodium sulfate (anhydrous) in a mixer glass fitted with a blade agitator. Over 1 minute, a solution consisting of 20.1 g of a 15% solution of Triclosan in $C_{12}$–$C_{15}$oxoalcoholethoxylate with 5 ethylene oxide units is added dropwise. The partly granular mixture is mixed for about 1.5 minutes in a mixer and heats up very much in the process.

8.1 g of deionised water are then added dropwise through the aperture in the mixer glass and the mixture is thoroughly mixed, resulting in a grayish granulate.

The sample is dried for 4 hours at 65° C. under vacuum and is then sieved through 3 sieves having mesh width of 2, 1 and 0.5 mm.

EXAMPLE 4

60 g of bentonite are stirred for 2 min with 20.0 g of sodium sulfate (anhydrous) in a mixer glass fitted with a blade agitator. Over 1 minute, a solution consisting of 20.0 g a 15% solution of Triclosan in nonylphenylethoxylate with 6.5 ethylene oxide units is added dropwise. The partly granular mixture is thoroughly stirred for about 1.5 minutes in a mixer and heats up very much in the process.

5.4 g of deionised water are then added dropwise through the aperture in the mixer glass and the mixture is thoroughly mixed, resulting in a grayish granulate.

The sample is dried for 4 hours at 65° C. under vacuum and is then sieved through 3 sieves having mesh widths of 2, 1 and 0.5 mm.

EXAMPLE 5 to 10

The general procedure of Examples 1 to 4 is repeated, but replacing Triclosan with the following compounds:

| Example | Antimicrobial active substance |
|---|---|
| 5 | Diclosan (compound of formula (6)) |
| 6 | 2,4-dichlorophenol |
| 7 | dichlorophen |
| 8 | dichlorobenzyl alcohol |

-continued

| Example | Antimicrobial active substance |
|---|---|
| 9 | chlorhexidine |
| 10 | coconut fatty acid-$C_8$–$C_{18}$amidopropylbetaine |

EXAMPLE 11

Measuring the oxidation stability of Triclosan in different Triclosan-bentonite compounds/detergent mixtures Implementation: The detergent additives prepared in Examples 1 to 4 are used to prepare a detergent formulation.

The single detergent additives are mixed dry with a standard detergent mixture, and a reference mixture Triclosan/standard detergent is likewise prepared. The detergents thus prepared have the following composition:

x % of detergent additive

12% of sodium perborate ×1 $H_2O$

3% of TAED ad 100% of ECE (=standard detergent of Henkel)

This detergent has the following composition (%):

| | |
|---|---|
| linear sodium alkylbenzenesulfonate | 8.0 |
| tallow alcohol tetradecane ethylene glycol ether | 2.9 |
| sodium soap | 3.5 |
| sodium triphosphate | 43.8 |
| sodium silicate | 7.5 |
| magnesium silicate | 1.9 |
| carboxymethyl cellulose | 1.2 |
| EDTA | 0.2 |
| sodium sulfate | 21.2 |
| water | 9.8 |

The reference mixture has the following composition 0.15% of Triclosan

12% of sodium perborate ×1 $H_2O$

3% of TAED

ECE ad 100%.

The required Triclosan content in the detergent compositions was analytically determined before the start of the test.

TABLE 1

| Detergent additive acc. to Example | Amount [%] | Triclosan starting [%] | Triclosan after 4 weeks/60° C. [%] |
|---|---|---|---|
| 1 | 5.8 | 0.16 | 0.07 |
| 2 | 6.2 | 0.17 | 0.08 |
| 3 | 7.3 | 0.20 | 0.13 |
| 4 | 8.1 | 0.21 | 0.13 |
| reference | — | 0.15 | 0.006 |

The result show that the detergents comprising the detergent additive of this invention have significantly higher concentrations of antimicrobial active substance (triclosan) and are therefore substantially more storage-stable than detergents comprising unaltered antimicrobial active substances.

What is claimed is:

1. A detergent additive in agglomerate form, which consists of (a) 5 to 60% by weight of a swellable layered silicate selected from natural or synthetic clay minerals and synthetic laminar sodium silicates;

(b) 5 to 35% by weight of surfactant;

(c) 0.1 to 20% by weight of an antimicrobially active substance of the formula (3)

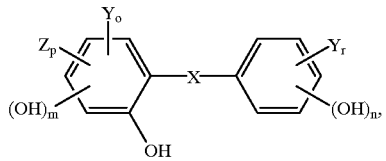

wherein

X is oxygen, sulfur or —$CH_2$—,

Y is chloro or bromo,

Z is $SO_2H$, $NO_2$ or $C_1$–$C_4$alkyl, r is 0 to 3, o is 0 to 3, p 0 or 1, m is 0 or 1, and n is 0 or 1, and (d) 0 to 60% by weight of alkali salt.

2. A detergent additive according to claim 1, which comprises 10 to 40% by weight of an alkali salt.

3. A detergent additive according to claim 1, which comprises the layered silicate in an amount from 10 to 50% by weight.

4. A detergent additive according to claim 1, wherein the surfactant is selected from the group consisting of the anionic and nonionic surfactants.

5. A detergent additive according to claim 4, wherein the nonionic surfactants are fatty alcohol ethoxylates of formula $$R—O—(EO)_y—H, \quad (2)$$

wherein

R is a hydrocarbon radical containing 10 to 18 carbon atoms; or a radical of formula (2a)

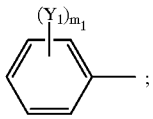

EO is an ethylene oxide group;

$Y_1$ is $C_1$–$C_{12}$alkyl, aryl or aralkyl;

$m_1$ is 1 to 4;

and y is a number from 2 to 20.

6. A detergent additive according to claim 5, wherein the nonionic surfactant is a compound of formula (2), wherein R is $C_{12}$–$C_{15}$alkyl; or a radical of formula (2a); and y is 3 to 10.

7. A detergent additive according to claim 1, wherein the antimicrobially active substance is the compound of formula (3), wherein X is oxygen, sulfur or —$CH_2$—and Y is chloro or bromo, m is 0, n is 0 or 1, o is 1 or 2, r is 1 or 2, and p is 0.

8. A detergent additive according to claim 1, wherein the antimicrobially active substance is the compound of formula

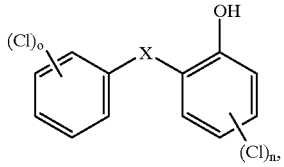

wherein

X is —O— or —$CH_2$—;

o is 1 to 3; and n is 1 or 2.

9. A detergent additive according to claim 8, which comprises the antimicrobially active substance of formula (5)

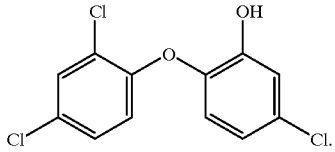

10. A detergent additive according to claim 8, which comprises the antimicrobially active substance of formula (6)

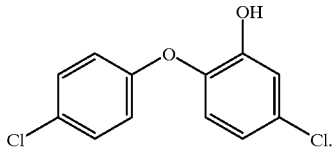

11. A detergent additive according to claim 2, wherein the alkali salt is alkali sulfate.

12. A process for the preparation of the detergent additive according to claim 1, which comprises (a) adding the antimicrobially active substance in the form of an aqueous dispersion to the layered silicate at the same time as the surfactant; or (b) first dissolving at least part of the antimicrobially active substance in the surfactant and then adding the solution to the layered silicate.

13. A detergent composition, which comprises the detergent additive according to claim 1.

* * * * *